US009948009B2

(12) United States Patent
Brandau et al.

(10) Patent No.: US 9,948,009 B2
(45) Date of Patent: Apr. 17, 2018

(54) CONTROLLED ILLUMINATION DIELECTRIC CONE RADIATOR FOR REFLECTOR ANTENNA

(71) Applicant: CommScope Technologies LLC, Hickory, NC (US)

(72) Inventors: Ronald J Brandau, Homer Glen, IL (US); Christopher D Hills, Glenrothes (GB)

(73) Assignee: CommScope Technologies LLC, Hickory, NC (US)

( * ) Notice: Subject to any disclaimer, the term of this patent is extended or adjusted under 35 U.S.C. 154(b) by 329 days.

(21) Appl. No.: 14/851,311

(22) Filed: Sep. 11, 2015

(65) Prior Publication Data

US 2016/0043474 A1 Feb. 11, 2016

Related U.S. Application Data

(63) Continuation of application No. 13/224,066, filed on Sep. 1, 2011, now abandoned.

(51) Int. Cl.
*H01Q 19/19* (2006.01)
*H01Q 19/13* (2006.01)

(52) U.S. Cl.
CPC ..... *H01Q 19/191* (2013.01); *H01Q 19/134* (2013.01); *H01Q 19/19* (2013.01); *H01Q 19/193* (2013.01)

(58) Field of Classification Search
CPC ..... H01Q 19/19; H01Q 19/13
USPC ..... 343/781
See application file for complete search history.

(56) References Cited

U.S. PATENT DOCUMENTS

| | | | | |
|---|---|---|---|---|
| 2,605,416 | A | 7/1952 | Foster | |
| 4,673,945 | A | 6/1987 | Syrigos | |
| 4,673,947 | A | 6/1987 | Newham | |
| 4,963,878 | A | 10/1990 | Kildal | |
| 5,959,590 | A | 9/1999 | Sanford et al. | |
| 5,973,652 | A * | 10/1999 | Sanford | H01Q 13/0208 343/781 CA |
| 6,020,859 | A | 2/2000 | Kildal | |
| 6,107,973 | A | 8/2000 | Knop et al. | |
| 6,137,449 | A | 10/2000 | Kildal | |
| 6,429,826 | B2 | 8/2002 | Karlsson et al. | |
| 6,456,253 | B1 | 9/2002 | Rummeli et al. | |

(Continued)

OTHER PUBLICATIONS

Schwering et al., Dielectric Omni-Directional Antennas, US Statutory Invention Registration No. H584, Feb. 7, 1987.

(Continued)

*Primary Examiner* — Andrea Lindgren Baltzell
(74) *Attorney, Agent, or Firm* — Myers Bigel, P.A.

(57) ABSTRACT

A dielectric cone radiator sub-reflector assembly for a reflector antenna with a waveguide supported sub-reflector is provided as a unitary dielectric block with a sub-reflector at a distal end. A waveguide transition portion of the dielectric block is dimensioned for coupling to an end of the waveguide. A dielectric radiator portion is provided between the waveguide transition portion and a sub-reflector support portion. An outer diameter of the dielectric radiator portion is provided with a plurality of radial inward grooves and a minimum diameter of the dielectric radiator portion is greater than ⅗ of a sub-reflector diameter of the sub-reflector support surface.

20 Claims, 8 Drawing Sheets

(56) References Cited

U.S. PATENT DOCUMENTS

| | | | | |
|---|---|---|---|---|
| 6,522,305 | B2 | 2/2003 | Sharman | |
| 6,697,027 | B2 | 2/2004 | Mahon | |
| 6,724,349 | B1 | 4/2004 | Baird et al. | |
| 6,862,000 | B2 | 3/2005 | Desargant et al. | |
| 6,919,855 | B2 | 7/2005 | Hills | |
| 6,985,120 | B2 | 1/2006 | Lewry et al. | |
| 6,995,727 | B2 | 2/2006 | Tuau et al. | |
| 7,907,097 | B2 | 3/2011 | Syed et al. | |
| 2002/0008670 | A1 | 1/2002 | Sharman | |
| 2005/0007288 | A1 | 1/2005 | Tuau | |
| 2005/0017916 | A1 | 1/2005 | Lewry et al. | |
| 2005/0062663 | A1* | 3/2005 | Hills ..... | H01Q 13/0216 343/781 P |
| 2009/0021442 | A1 | 1/2009 | Sharman | |

OTHER PUBLICATIONS

International Search Report, related application No. PCT/US12/41879, dated Jul. 25, 2013, Korea Intellectual Property Office, Daejeon Metropolitan City, Republic of Korea.

International Search Report, related application No. PCT/US12/41884, dated Jan. 10, 2013, Korea Intellectual Property Office, Daejeon Metropolitan City, Republic of Korea.

* cited by examiner

CONTROLLED ILLUMINATION DIELECTRIC CONE RADIATOR FOR REFLECTOR ANTENNA

BACKGROUND

Field of the Invention

This invention relates to a microwave dual reflector antenna. More particularly, the invention provides a low cost self supported feed cone radiator for such antennas enabling improved control of the signal radiation pattern characteristics.

Description of Related Art

Dual reflector antennas employing self-supported feed direct a signal incident on the main reflector onto a sub-reflector mounted adjacent to the focal region of the main reflector, which in turn directs the signal into a waveguide transmission line typically via a feed horn or aperture to the first stage of a receiver. When the dual reflector antenna is used to transmit a signal, the signals travel from the last stage of the transmitter system, via the waveguide, to the feed aperture, sub-reflector, and main reflector to free space.

The electrical performance of a reflector antenna is typically characterized by its gain, radiation pattern, cross-polarization and return loss performance—efficient gain, radiation pattern and cross-polarization characteristics are essential for efficient microwave link planning and coordination, whilst a good return loss is necessary for efficient radio operation.

These principal characteristics are determined by a feed system designed in conjunction with the main reflector profile.

Deep dish reflectors are reflector dishes wherein the ratio of the reflector focal length (F) to reflector diameter (D) is made less than or equal to 0.25 (as opposed to an F/D of 0.35 typically found in more conventional dish designs). Such designs can achieve improved radiation pattern characteristics without the need for a separate shroud assembly when used with a carefully designed feed system which provides controlled dish illumination, particularly toward the edge of the dish.

An example of a dielectric cone feed sub-reflector configured for use with a deep dish reflector is disclosed in commonly owned U.S. Pat. No. 6,919,855, titled "Tuned Perturbation Cone Feed for Reflector Antenna" issued Jul. 19, 2005 to Hills, hereby incorporated by reference in its entirety. U.S. Pat. No. 6,919,855 utilizes a dielectric block cone feed with a sub-reflector surface and a leading cone surface having a plurality of downward angled non-periodic perturbations concentric about a longitudinal axis of the dielectric block. The cone feed and sub-reflector dimensions are minimized where possible, to prevent blockage of the signal path from the reflector dish to free space. Although a significant improvement over prior designs, such configurations have signal patterns in which the sub-reflector edge and distal edge of the feed boom radiate a portion of the signal broadly across the reflector dish surface, including areas proximate the reflector dish periphery and/or a shadow area of the sub-reflector where secondary reflections with the feed boom and/or sub-reflector may be generated, degrading electrical performance. Further, the plurality of angled features and/or steps in the dielectric block requires complex manufacturing procedures which increase the overall manufacturing cost.

Therefore it is the object of the invention to provide an apparatus that overcomes limitations in the prior art, and in so doing present a solution that allows such a feed design to provide reflector antenna characteristics which meet the most stringent electrical specifications over the entire operating band used for a typical microwave communication link.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that improvements in radiation pattern control and thus overall reflector antenna performance may be realized by reducing or minimizing the electrical effect of the feed boom end and sub-reflector overspill upon the radiation pattern of conventional dielectric cone sub-reflector assemblies.

Figure 1:
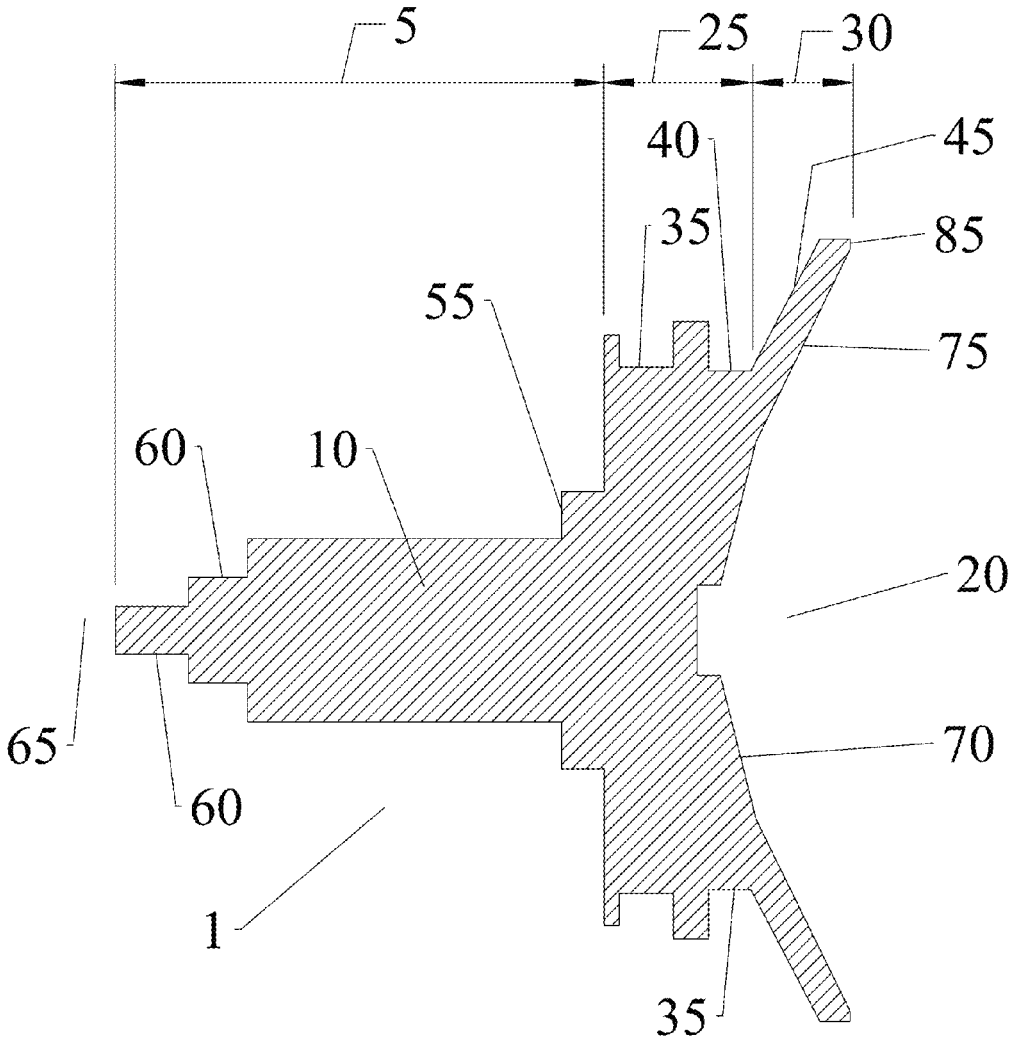
FIG. 1 is a schematic cut-away side view of an exemplary controlled illumination dielectric cone sub-reflector assembly.
Figure 2:
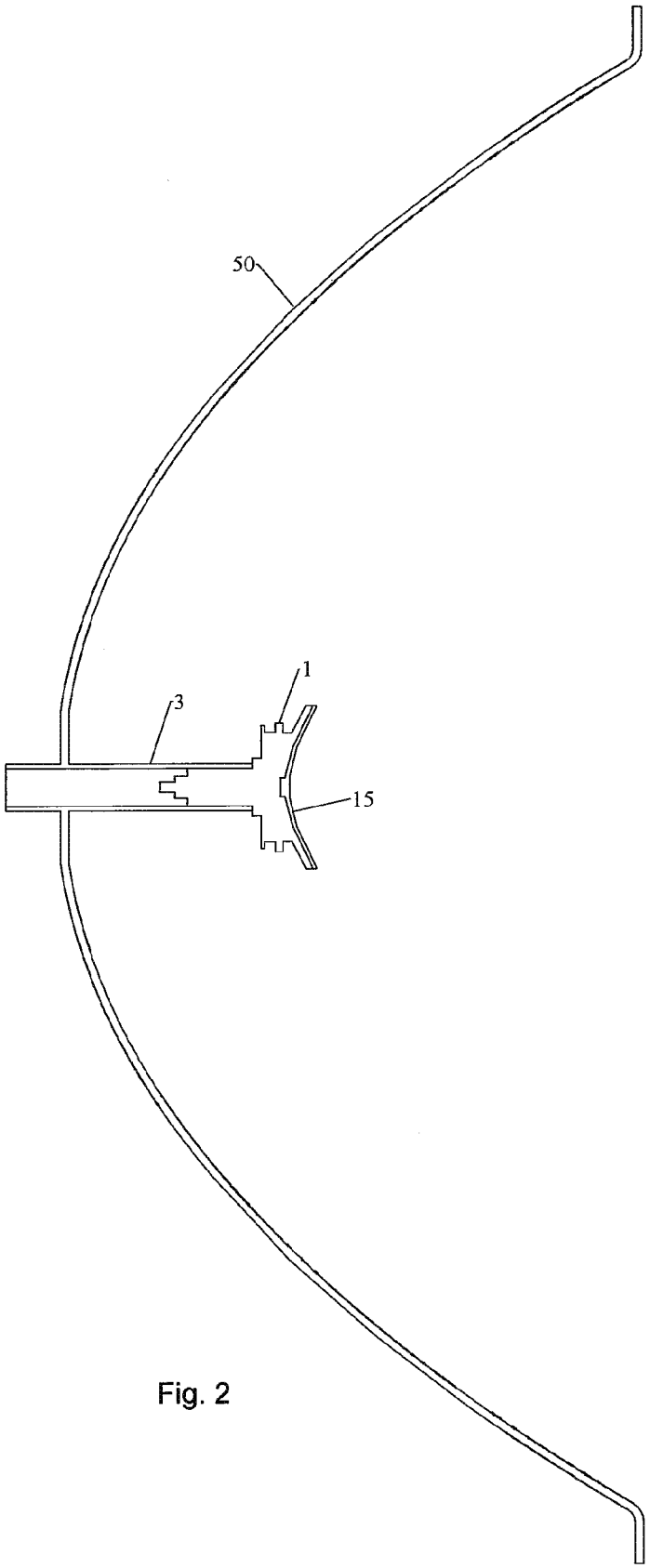
FIG. 2 is a schematic cut-away side view of the sub-reflector assembly of FIG. 4, mounted within a 0.167 F/D deep dish reflector antenna.
Figure 4:
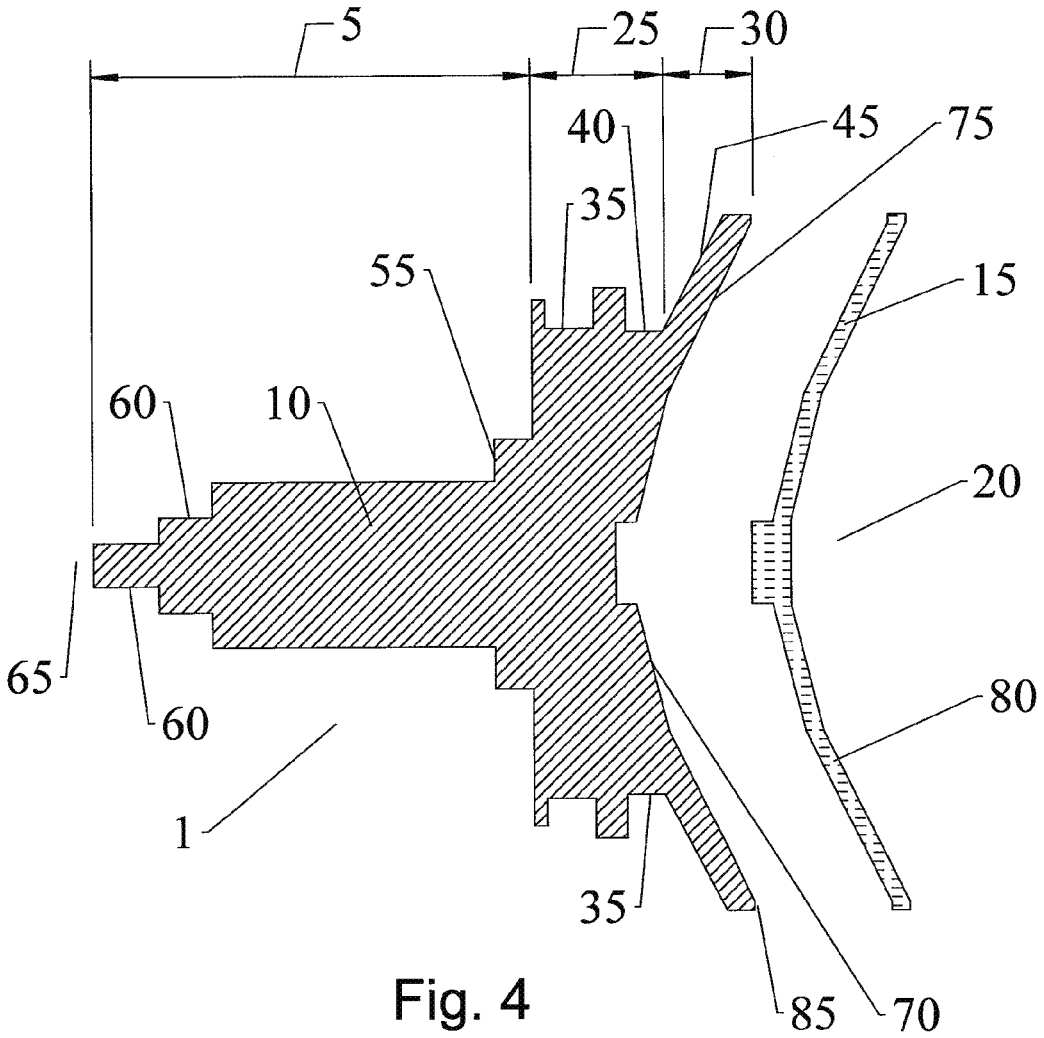
FIG. 4 is an exploded schematic cut-away side view of the sub-reflector assembly of FIG. 1, illustrated with a separate metal disc type sub-reflector.
Figure 5:
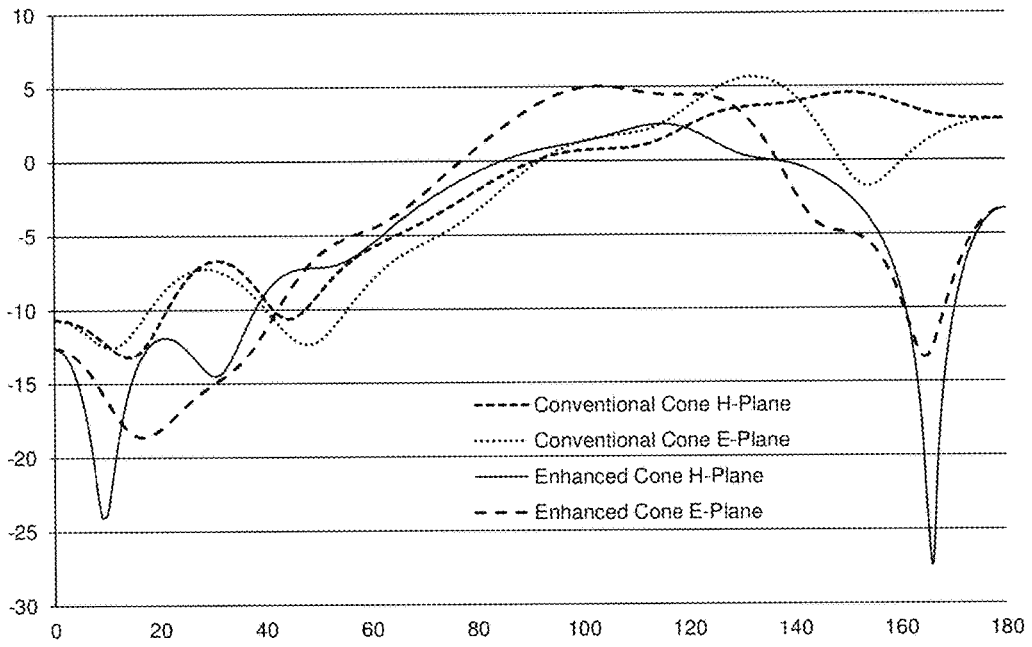
FIG. 5 is an E & H plane primary radiation amplitude pattern modeled comparison chart for the sub-reflector assemblies of FIG. 1 and FIG. 3 operating at 22.4 Ghz, wherein the dot line is FIG. 3 E plane, short dash line is FIG. 3 H Plane, long dash line is FIG. 1 E plane and the solid line is FIG. 1 H plane.

As shown in FIGS. 1, 2 and 4, a cone radiator sub-reflector assembly 1 is configured to couple with the end of a feed boom waveguide 3 at a waveguide transition portion 5 of a unitary dielectric block 10 which supports a sub-reflector 15 at the distal end 20. The sub-reflector assembly 1 utilizes an enlarged sub-reflector diameter for reduction of sub-reflector spill-over. The sub-reflector 15 may be dimensioned, for example, with a diameter that is 2.5 wavelengths or more of a desired operating frequency, such as the mid-band frequency of a desired microwave frequency band. The exemplary embodiment is dimensioned with a 39.34 mm outer diameter and a minimum dielectric radiator portion diameter of 26.08 mm, which at a desired operating frequency in the 22.4 Ghz microwave band corresponds to 2.94 and 1.95 wavelengths, respectively.

Figure 3:
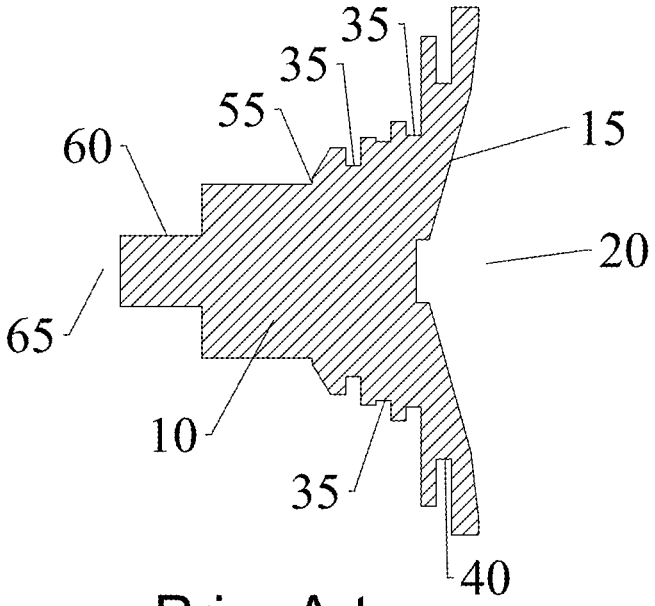
Prior Art Fig. 3
FIG. 3 is a schematic cut-away side view of a prior art dielectric cone sub-reflector assembly.

A dielectric radiator portion 25 situated between the waveguide transition portion 5 and a sub-reflector support portion 30 of the dielectric block 10 is also increased in size. The dielectric radiator portion 25 may be dimensioned, for example, with a minimum diameter of at least ⅗ of the sub-reflector diameter. The enlarged dielectric radiator portion 25 is operative to pull signal energy outward from the end of the waveguide 3, thus minimizing the diffraction at this area observed in conventional dielectric cone sub-reflector configurations, for example as shown in FIG. 3. The conventional dielectric cone has an outer diameter of 28 mm and a minimum diameter in a "radiator region" of 11.2 mm, which at a desired operating frequency in the 22.4 Ghz microwave band corresponds to corresponding to 2.09 and 0.84 wavelengths, respectively.

A plurality of corrugations are provided along the outer diameter of the dielectric radiator portion as radial inward grooves 35. In the present embodiment, the plurality of grooves is two grooves 35. A distal groove 40 of the dielectric radiator portion 25 may be provided with an angled distal sidewall 45 that initiates the sub-reflector support portion 30. The distal sidewall 45 may be generally parallel to a longitudinally adjacent portion of the distal end 20, that is, the distal sidewall 45 may form a conical surface parallel to the longitudinally adjacent conical surface of the distal end 20 supporting the sub-reflector 15, so that a dielectric thickness along this surface is constant with respect to the sub-reflector 45.

The waveguide transition portion 5 of the sub-reflector assembly 1 may be adapted to match a desired circular waveguide internal diameter so that the sub-reflector assembly 1 may be fitted into and retained by the waveguide 3 that supports the sub-reflector assembly 1 within the dish reflector 50 of the reflector antenna proximate a focal point of the dish reflector 50. The waveguide transition portion 5 may insert into the waveguide 3 until the end of the waveguide abuts a shoulder 55 of the waveguide transition portion 5.

The shoulder 55 may be dimensioned to space the dielectric radiator portion 25 away from the waveguide end and/or to further position the periphery of the distal end 20 (the farthest longitudinal distance of the sub-reflector signal surface from the waveguide end) at least 0.75 wavelengths of the desired operating frequency. The exemplary embodiment is dimensioned with a 14.48 mm longitudinal length, which at a desired operating frequency in the 22.4 Ghz microwave band corresponds to 1.08 wavelengths. For comparison, the conventional dielectric cone of FIG. 3 is dimensioned with 8.83 mm longitudinal length or 0.66 wavelengths at the same desired operating frequency.

One or more step(s) 60 at the proximal end 65 of the waveguide transition portion 5 and/or one or more groove(s) may be used for impedance matching purposes between the waveguide 3 and the dielectric material of the dielectric block 10.

The sub-reflector 15 is demonstrated with a proximal conical surface 70 which transitions to a distal conical surface 75, the distal conical surface 75 provided with a lower angle with respect to a longitudinal axis of the sub-reflector assembly 1 than the proximal conical surface 70.

As best shown in FIG. 1, the sub-reflector 15 may be formed by applying a metallic deposition, film, sheet or other RF reflective coating to the distal end of the dielectric block 10. Alternatively, as shown in FIGS. 2 and 4, the sub-reflector 15 may be formed separately, for example as a metal disk 80 which seats upon the distal end of the dielectric block 10.

Figure 6:
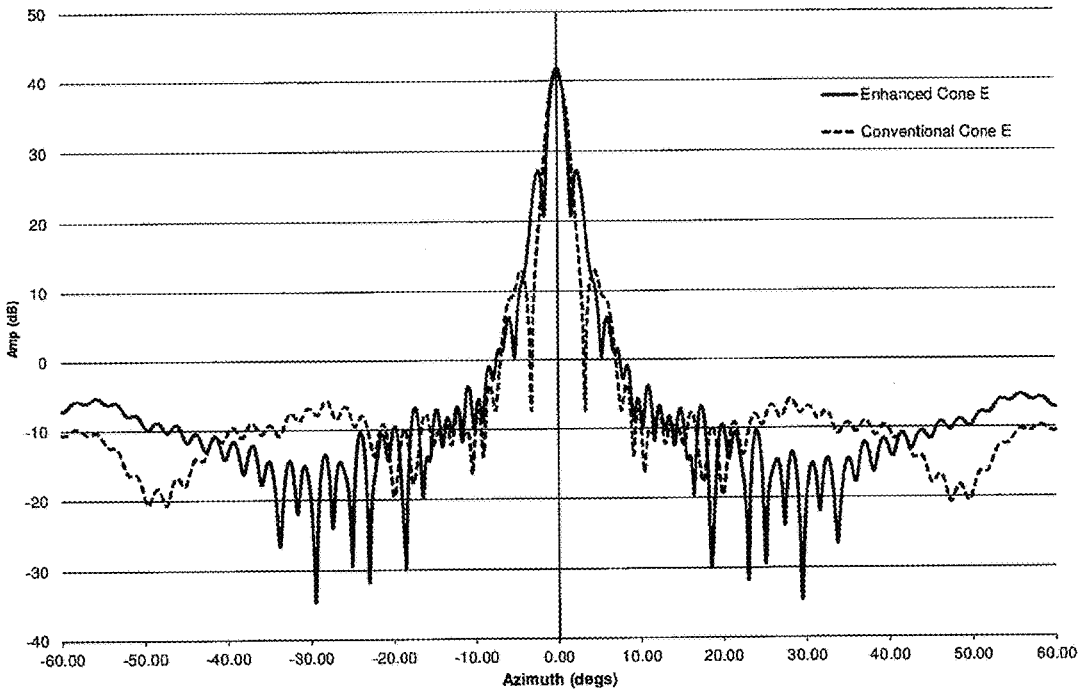
FIG. 6 is an E plane radiation pattern model comparison chart for the dielectric cone feeds of FIG. 1 and FIG. 3 mounted within a 0.167 F/D reflector dish according to FIG. 2.
Figure 7:
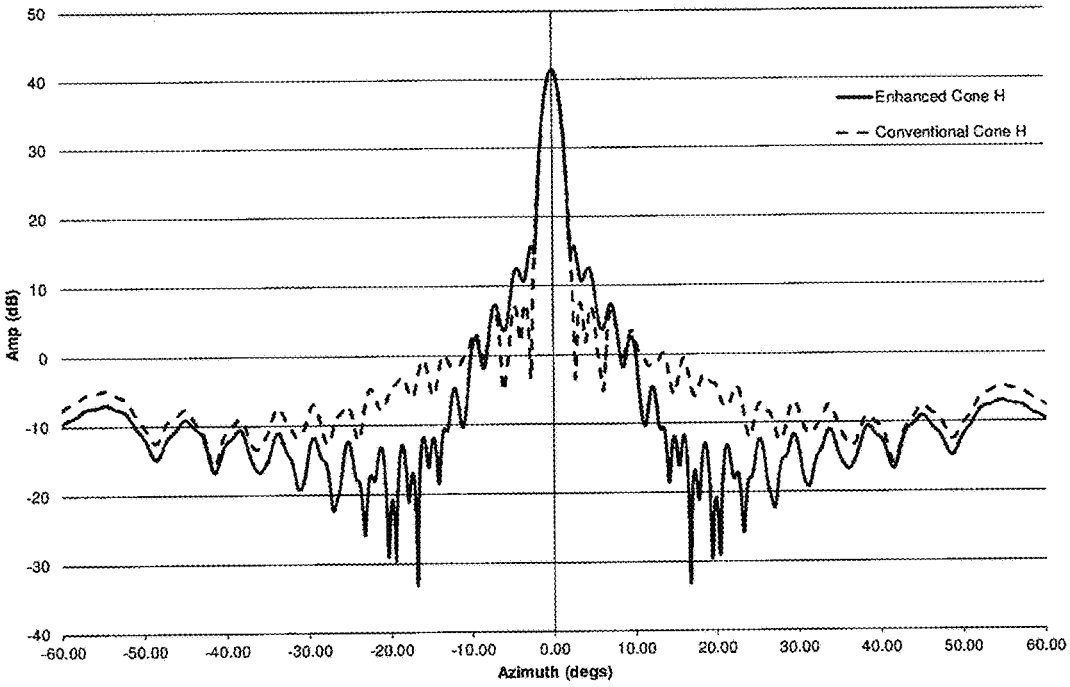
FIG. 7 is an H plane radiation pattern model comparison chart for the dielectric cone feeds of FIG. 1 and FIG. 3 mounted within a 0.167 F/D reflector dish according to FIG. 2.

When applied with an 0.167 F/D deep dish reflector 50, the sub-reflector assembly 1 provides surprising improvements in the signal pattern, particularly in the region between 10 and 45 degrees. For example, as shown in FIGS. 6 and 7, radiation in both the E & H planes is significantly reduced in the 10 to 45 degree region.

Figure 8:
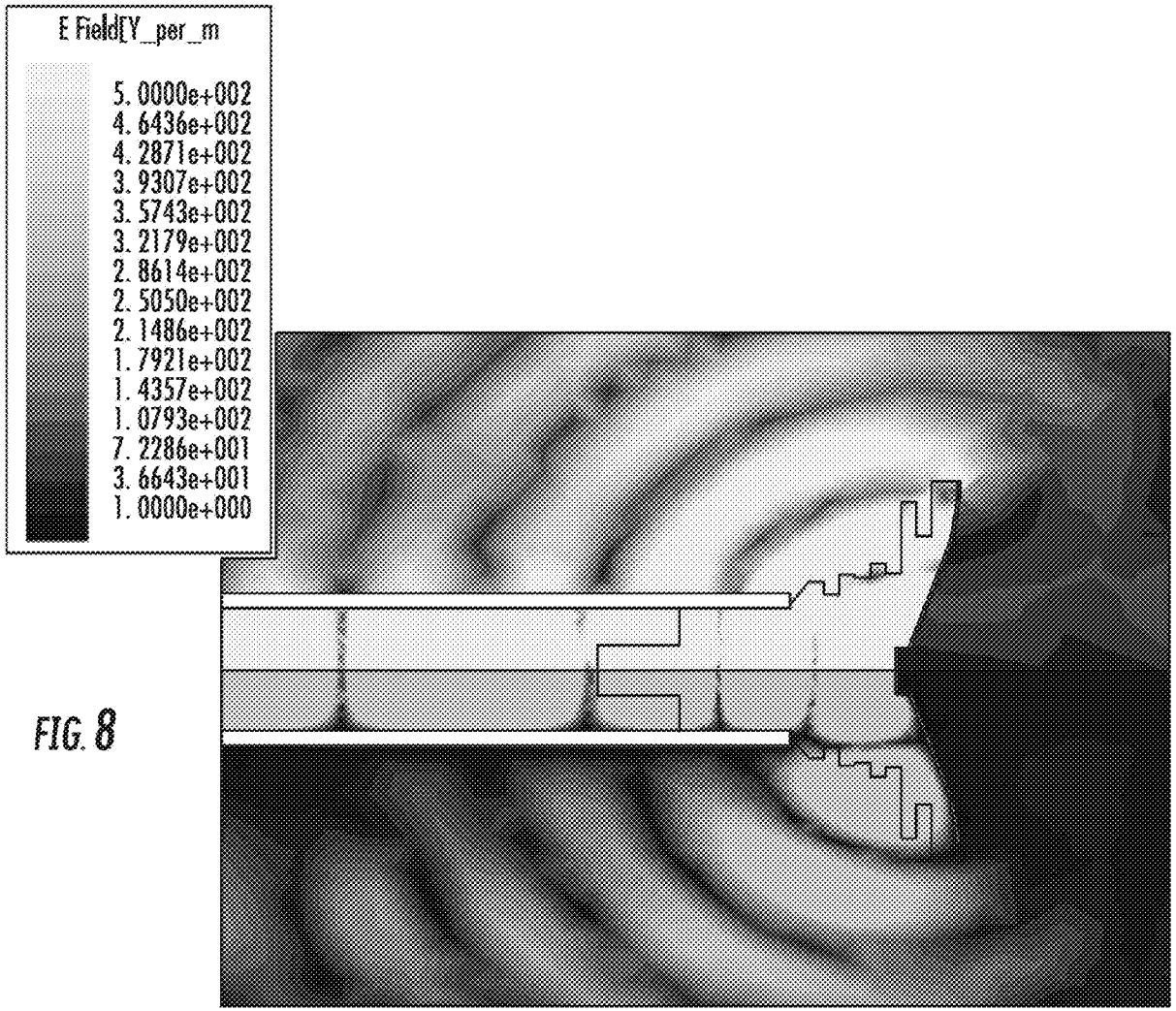
FIG. 8 is an E (top half) & H (bottom half) plane energy field distribution model for the sub-reflector assembly of FIG. 3 (model is a planar rendering of quarter symmetry).

FIG. 8 demonstrates a time slice radiation energy plot simulation of a conventional sub-reflector assembly, showing the broad angular spread of the radiation pattern towards the reflector dish surface and in particular the diffraction effect of the waveguide end drawing the signal energy back along the boresight which necessitates the limiting of the sub-reflector diameter to prevent significant signal blockage and/or introduction of electrical performance degrading secondary reflections/interference.

Figure 9:
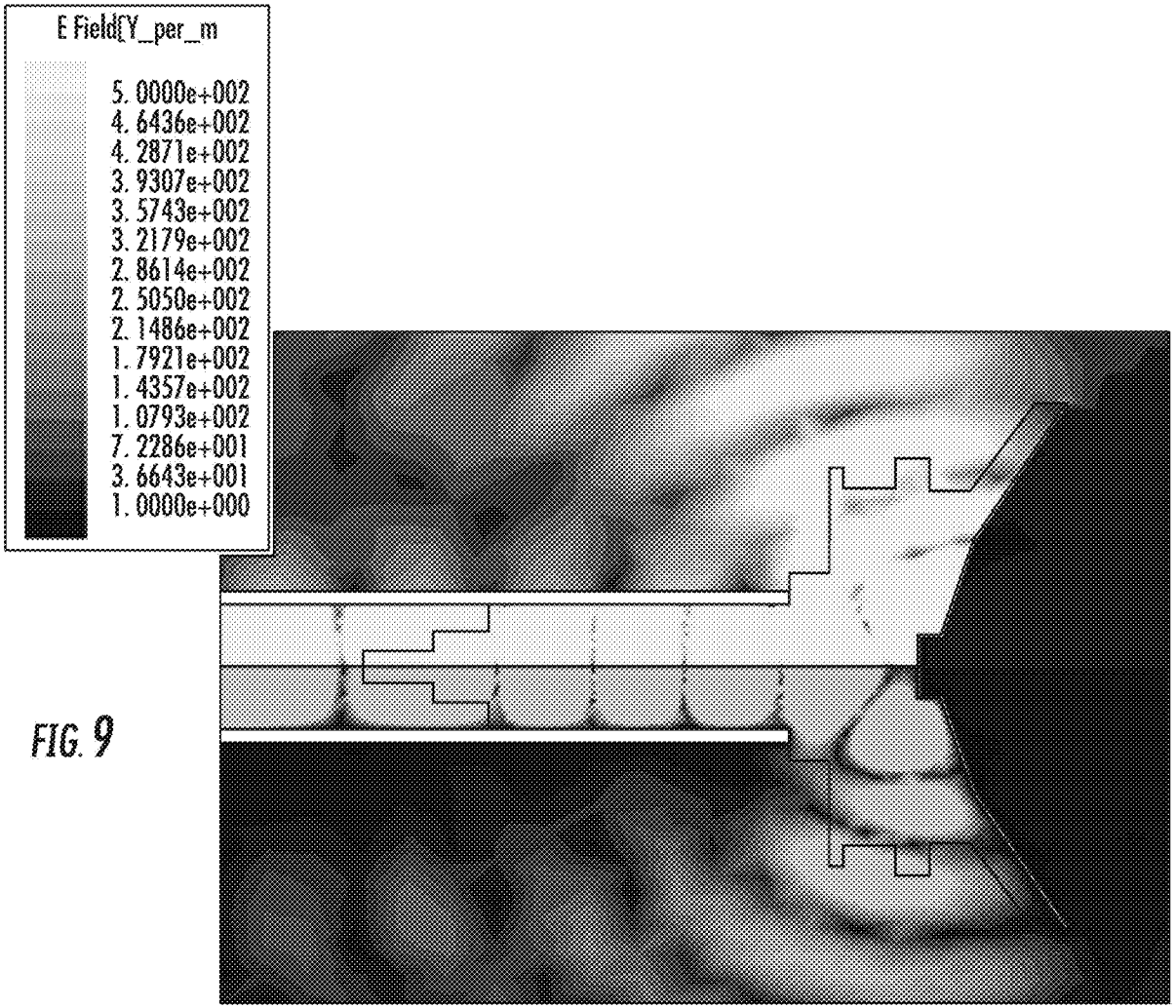
FIG. 9 is an E (top half) & H (bottom half) plane primary energy field distribution model for the sub-reflector assembly of FIG. 1 (model is a planar rendering of quarter symmetry).

In contrast, FIG. 9 shows a radiation energy plot simulation of the exemplary controlled illumination cone radiator sub-reflector assembly 1 demonstrating the controlled illumination of the dish reflector 50 by the sub-reflector assembly 1 as the radiation pattern is directed primarily towards an area of the dish reflector 50 spaced away both from the sub-reflector shadow area and the periphery of the dish reflector 50.

One skilled in the art will appreciate that while additional shielding and/or radiation absorbing materials may be applied to assist with correction of the radiation pattern with respect to the boresight and/or sub-reflector spill-over regions, the reduction in these regions, along with the previously unobtainable 10 to 45 degree region radiation reduction has been obtained in the present example without any such additional structure. As this signal pattern improvement is made without absorbing the signal energy projected in unwanted directions by additional means, more of the signal energy is applied to the free space target, resulting in a 6% improved antenna efficiency measured by the inventor's software based models of the exemplary embodiment operating in the 22.4 Ghz microwave band.

Where each of the shoulders 55, steps 60 and grooves 35 formed along the outer diameter of the unitary dielectric block are provided radially inward, manufacture of the dielectric block may be simplified, reducing overall manufacturing costs. Dimensioning the periphery of the distal surface as normal to the a longitudinal axis of the assembly provides a ready manufacturing reference surface 85, further simplifying the dielectric block 10 manufacture process, for example by machining and/or injection molding.

From the foregoing, it will be apparent that the present invention brings to the art a sub-reflector assembly 1 for a reflector antenna with improved electrical performance and significant manufacturing cost efficiencies. The sub-reflector assembly 1 according to the invention is strong, lightweight and may be repeatedly cost efficiently manufactured with a very high level of precision.

Table of Parts

| | |
|---|---|
| 1 | sub-reflector assembly |
| 3 | waveguide |
| 5 | waveguide transition portion |
| 10 | dielectric block |
| 15 | sub-reflector |

-continued

| Table of Parts | |
|---|---|
| 20 | distal end |
| 25 | dielectric radiator portion |
| 30 | sub-reflector support portion |
| 35 | groove |
| 40 | distal groove |
| 45 | distal sidewall |
| 50 | dish reflector |
| 55 | shoulder |
| 60 | step |
| 65 | proximal end |
| 70 | proximal conical surface |
| 75 | distal conical surface |
| 80 | disk |
| 85 | reference surface |
| 90 | shield |
| 95 | RF absorbing material |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A method for illuminating a dish reflector of a reflector antenna, comprising:

providing a waveguide coupled to a dish reflector; wherein the waveguide is aligned with a longitudinal axis of the reflector antenna;

providing a sub-reflector positioned proximate an end of the waveguide, wherein the sub-reflector is spaced away from a distal end of the waveguide by a unitary dielectric block;

wherein the unitary dielectric block comprises a dielectric radiator portion between a waveguide transition portion and a sub-reflector support portion, wherein the waveguide transition portion is dimensioned for coupling to the distal end of the waveguide, and wherein the sub-reflector support portion is configured to support the sub-reflector;

wherein the dielectric radiator portion is provided with a diameter that is greater than ⅗ of a diameter of the sub-reflector;

wherein the dielectric radiator portion is dimensioned such that a radiation pattern from the sub-reflector to the dish reflector is primarily upon an area of the dish reflector spaced away both from a sub-reflector shadow area and a periphery of the dish reflector, wherein the sub-reflector support portion extends from a distal groove of the dielectric radiator portion as an angled distal sidewall of the distal groove; and wherein the angled distal sidewall is generally parallel to a longitudinally adjacent portion of a distal end of the unitary dielectric block, with respect to a longitudinal axis of the unitary dielectric block.

2. The method of claim 1, wherein the dish reflector has a ratio of reflector focal length to reflector diameter that is less than or equal to 0.25.

3. The method of claim 2, wherein the ratio of reflector focal length to reflector diameter is less than or equal to 0.167.

4. The method of claim 1, wherein an outer diameter of the dielectric radiator portion is provided with a plurality of radial inward grooves, and wherein the plurality of radial inward grooves comprises the distal groove.

5. The method of claim 1, wherein the sub-reflector is formed by applying a metal coating upon the distal end of the unitary dielectric block.

6. The method of claim 1, wherein the sub-reflector is provided as a separate metal portion seated upon the distal end of the unitary dielectric block.

7. The method of claim 1, wherein the diameter of the sub-reflector is 2.5 wavelengths or more of a desired operating frequency.

8. The method of claim 1, wherein the waveguide transition portion is dimensioned for insertion into the distal end of the waveguide until the distal end of the waveguide abuts a shoulder of the waveguide transition portion.

9. The method of claim 1, wherein the sub-reflector is provided with a proximal conical surface which transitions to a distal conical surface; the distal conical surface provided with a lower angle with respect to the longitudinal axis of the unitary dielectric block than the proximal conical surface.

10. The method of claim 9, wherein the angled distal sidewall is generally parallel to the distal conical surface.

11. The method of claim 1, wherein a periphery of the distal end of the unitary dielectric block is normal to the longitudinal axis of the unitary dielectric block.

12. The method of claim 4, wherein the plurality of radial inward grooves is two radial inward grooves.

13. The method of claim 12, wherein a bottom width of the plurality of radial inward grooves decreases towards the distal end of the unitary dielectric block.

14. The method of claim 1, wherein a longitudinal distance between the distal end of the waveguide and the distal end of the unitary dielectric block at a periphery of the sub-reflector is at least 0.75 wavelengths of a desired operating frequency.

15. A method for forming a sub-reflector for a deep dish reflector antenna, comprising:

forming a dielectric block; and coupling a sub-reflector to a distal end of the dielectric block;

wherein a waveguide transition portion of the dielectric block is dimensioned for coupling to an end of a waveguide; wherein a sub-reflector support portion of the dielectric block is configured to support a sub-reflector;

wherein a dielectric radiator portion is positioned between the waveguide transition portion and the sub-reflector support portion;

wherein an outer diameter of the dielectric radiator portion is provided with a plurality of radial inward grooves;

wherein a minimum diameter of the dielectric radiator portion is greater than ⅗ of a diameter of the sub-reflector;

wherein the sub-reflector support portion extends from a distal groove of the dielectric radiator portion as an angled distal sidewall of the distal groove; and wherein the angled distal sidewall is provided generally parallel to a longitudinally adjacent portion of the distal end of the dielectric block, with respect to a longitudinal axis of the dielectric block.

16. The method of claim 15, wherein the diameter of the sub-reflector is 2.5 wavelengths or more of a desired operating frequency.

17. The method of claim 15, wherein a longitudinal distance between the end of the waveguide and the distal end of the dielectric block at a periphery of the sub-reflector is at least 0.75 wavelengths of a desired operating frequency.

18. A method for illuminating a dish reflector of a reflector antenna, comprising:

providing a waveguide coupled to a dish reflector; wherein the waveguide is aligned with a longitudinal axis of the reflector antenna;

providing a sub-reflector positioned proximate an end of the waveguide, wherein the sub-reflector is spaced away from a distal end of the waveguide by a unitary dielectric block;

wherein the unitary dielectric block comprises a dielectric radiator portion between a waveguide transition portion and a sub-reflector support portion, wherein the waveguide transition portion is dimensioned for coupling to the distal end of the waveguide, and wherein the sub-reflector support portion is configured to support the sub-reflector;

wherein the dielectric radiator portion is provided with a diameter that is greater than 3/5 of a diameter of the sub-reflector;

wherein the dielectric radiator portion is dimensioned such that a radiation pattern from the sub-reflector to the dish reflector is primarily upon an area of the dish reflector spaced away both from a sub-reflector shadow area and a periphery of the dish reflector, and wherein the dish reflector has a ratio of reflector focal length to reflector diameter that is less than or equal to 0.167.

19. The method of claim 18, wherein the sub-reflector is provided with a proximal conical surface which transitions to a distal conical surface; the distal conical surface provided with a lower angle with respect to the longitudinal axis of the unitary dielectric block than the proximal conical surface.

20. The method of claim 18, wherein the diameter of the sub-reflector is 2.5 wavelengths or more of a desired operating frequency.

* * * * *